US009824839B2

(12) United States Patent
Watford

(10) Patent No.: US 9,824,839 B2
(45) Date of Patent: Nov. 21, 2017

(54) CONNECTOR ASSEMBLIES FOR PANEL BOARD NEUTRAL BARS AND CIRCUIT BREAKERS INCLUDING SAME

(71) Applicant: Siemens Industry, Inc., Alpharetta, GA (US)

(72) Inventor: Russell Thomas Watford, Lawrenceville, GA (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 118 days.

(21) Appl. No.: 14/801,887

(22) Filed: Jul. 17, 2015

(65) Prior Publication Data

US 2016/0314926 A1 Oct. 27, 2016

Related U.S. Application Data

(60) Provisional application No. 62/150,917, filed on Apr. 22, 2015.

(51) Int. Cl.
*H01H 1/58* (2006.01)
*H01R 13/70* (2006.01)
(Continued)

(52) U.S. Cl.
CPC ..... *H01H 71/025* (2013.01); *H01R 4/4863* (2013.01)

(58) Field of Classification Search
CPC ..... H01H 1/58; H01H 13/70; H01H 25/14; H01H 1/00; H01H 1/12; H01H 1/24; H01H 1/242; H01H 1/245; H01H 1/26; H01H 1/28; H01H 9/00; H01H 9/02; H01H 9/38; H01H 71/00; H01H 71/002; H01H 71/02; H01H 71/0207; H01H 71/0235; H01H 71/08; H01H 71/52; H01H 71/66; H01H 73/00; H01H 73/02; H01H 73/04;
(Continued)

(56) References Cited

U.S. PATENT DOCUMENTS 2,962,571 A * 11/1960 Zanichkowsky ..... H01H 13/12 200/535
3,001,172 A * 9/1961 Cornell, Jr. ..... H01R 11/09 439/798
(Continued)

FOREIGN PATENT DOCUMENTS

CN 202444087 U 9/2012
WO 2014209325 A1 12/2014

OTHER PUBLICATIONS

Canadian Office Action dated Dec. 2, 2016 corresponding to Canadian Application No. 2927698 filed Apr. 20, 2016 (5 pages).

*Primary Examiner* — Anthony R. Jimenez

(57) ABSTRACT

A circuit breaker neutral connector assembly is provided. Circuit breaker neutral connector assembly includes a neutral connector including a first side configured to make electrical connection with a neutral bar, a shield of an insulating material abutting a second side of the neutral connector opposite the first side, and a bias spring abutting the shield and configured to bias the neutral connector relative to a circuit breaker housing. Electronic circuit breakers including a circuit breaker neutral connector assembly and methods of making neutral connections are provided, as are other aspects.

20 Claims, 13 Drawing Sheets

(51) Int. Cl.
*H01R 25/14* (2006.01)
*H01H 71/02* (2006.01)
*H01R 4/48* (2006.01)

(58) Field of Classification Search
CPC .. H01H 73/06; H01H 73/20; H01H 2203/034; H01H 2203/04; H01H 2235/00
USPC ..... 200/51 R
See application file for complete search history.

(56) References Cited

U.S. PATENT DOCUMENTS

| | | | | |
|---|---|---|---|---|
| 6,482,048 | B1 | 11/2002 | Fleege et al. | |
| 8,049,126 | B2 | 11/2011 | Chen et al. | |
| 8,693,169 | B2 | 4/2014 | Diaz et al. | |
| 8,929,055 | B2 | 1/2015 | Potratz et al. | |
| 8,953,306 | B2 | 2/2015 | Wheeler et al. | |
| 9,048,054 | B2 | 6/2015 | Potratz | |
| 9,455,530 | B2 * | 9/2016 | Patel | H01R 13/652 |
| 2011/0002089 | A1 | 1/2011 | Sharp | |
| 2014/0321005 | A1 | 10/2014 | Samuelson et al. | |
| 2016/0314926 | A1 | 10/2016 | Watford | |

* cited by examiner

"Prior Art"

"Prior Art"

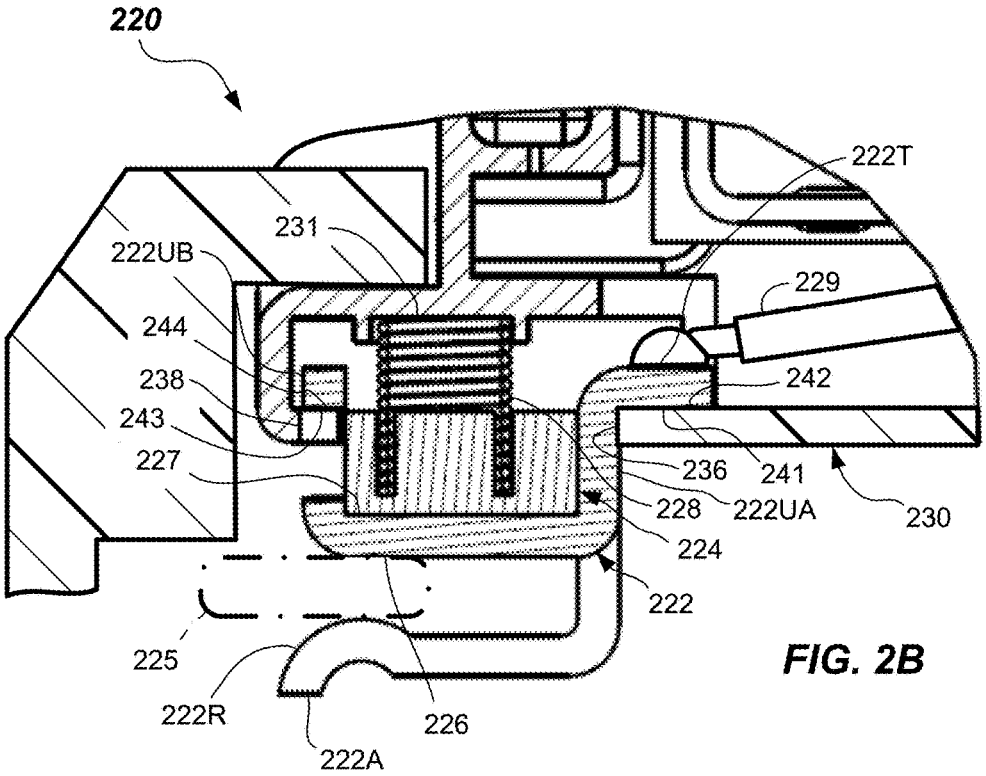
FIG. 2B
FIG. 2C
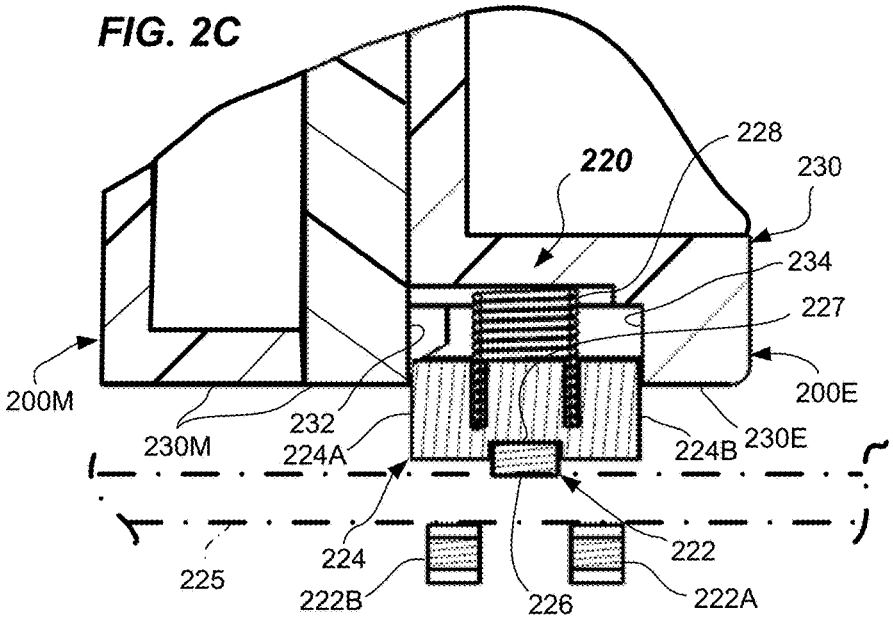

CONNECTOR ASSEMBLIES FOR PANEL BOARD NEUTRAL BARS AND CIRCUIT BREAKERS INCLUDING SAME

RELATED APPLICATION

The present application claims priority to U.S. Provisional Application No. 62/150,917 entitled "FLOATING CONNECTOR FOR A PANEL BOARD NEUTRAL BAR" filed on Apr. 22, 2015, which is hereby incorporated by reference in its entirety and for all purposes herein.

FIELD

Embodiments of the present invention relate to electronic circuit breakers used for arc fault or ground fault detection, and more specifically to neutral connections for such electronic circuit breakers.

BACKGROUND

As shown in FIG. 1A, prior art electronic circuit breakers 100A used for arc fault or ground fault detection, such as Ground Fault Circuit Interrupters (GFCIs) and Combination Arc Fault Circuit Interrupters (CAFCIs) typically include an external pigtail wire 102 that is used to connect to the panel board neutral, such as neutral bar. During installation, the pigtail wire is unraveled, measured, cut to length, end stripped, and then manipulated into place in a neutral bar socket of the neutral bar. This is a very labor intensive process.

Certain one-pole and two-pole electronic residential circuit breakers 100A may use mounting features, such as a mounting tab 103, on the load side of the circuit breaker 100A to help hold the circuit breaker in position on a panel board. The pigtail wire 102 connects internally to the electronics of the residential circuit breaker 100A. In the depicted embodiment, the pigtail wire 102 may have about 13 inch to about 20 inch (about 33 cm to about 51 cm) of 12AWG wire used to connect to the neutral bar on the panel board. The free end of the pigtail wire 102 may be secured into the neutral socket of the neutral bar, and may be held in place with a screw.

While most circuit breakers have historically used a pigtail wire 102 to connect to the panel board neutral bar, recently some manufacturers have begun to use a C-clip 104, as shown in FIG. 1B, to connect directly to a panel board neutral bar on the underside of the circuit breaker 100B. In this plug-on neutral design, the circuit breaker 100B is pushed directly on to a stab on the line side and onto a panel board neutral bar on the load side at the same time.

Existing pigtail neutral designs have a disadvantage of relatively high installation costs when an installer unravels, measures, cuts to length, strips the end of insulation, and then manipulates the pigtail 102 to insert the stripped end into a neutral socket of the neutral bar. Some existing C-clip designs, such as shown in FIG. 1B, have the disadvantage that once the circuit breaker is plugged onto the stab and neutral bar, there is limited ability to capture the breaker from coming off (becoming unplugged) or moving.

Accordingly, there is a need for an improved method of connecting the circuit breaker neutral to the panel board neutral bar, while at the same time providing capability to hold the electronic circuit breaker securely in place on the panel board.

SUMMARY

In accordance with a first aspect, a circuit breaker neutral connector assembly is provided. The circuit breaker neutral connector includes a neutral connector including a first side configured to make electrical connection with a neutral bar, a shield of an insulating material abutting a second side of the neutral connector opposite the first side, and a bias spring abutting the shield and configured to bias the neutral connector.

According to another aspect, a circuit breaker is provided. The circuit breaker includes a housing including a pocket, a neutral connector assembly at least partially received in the pocket, the neutral connector assembly comprising: a neutral connector including a first side configured to make electrical connection with a neutral bar, a shield of an insulating material abutting a second side of the neutral connector opposite the first side, and a bias spring abutting the shield and the pocket and configured to bias the neutral connector against limit stops.

According to another aspect, a method of making a neutral connection is provided. The method includes providing a housing including a pocket, and a circuit breaker neutral connector assembly at least partially received in the pocket, the circuit breaker neutral connector assembly comprising a neutral connector including a first side configured to make electrical connection with a neutral bar, a shield of an insulating material abutting a second side of the neutral connector opposite the first side, and bias spring abutting the shield and the pocket and configured to bias the neutral connector against one or more limit stops, and connecting the neutral connector to the neutral bar wherein during the connecting, the neutral connector floats in the pocket.

Still other aspects, features, and advantages of the present invention may be apparent from the following description and example embodiments, including the best mode contemplated for carrying out the present invention. The present invention may be capable of different embodiments, and its details may be modified without departing from the scope of the present invention. The invention is to cover all modifications, equivalents, and alternatives within the scope of the claims.

BRIEF DESCRIPTION OF DRAWINGS

The drawings, described below, are for illustrative purposes only and are not necessarily drawn to scale. The drawings are illustrative and not intended to limit the scope of the invention in any way. Wherever possible, the same or like reference numbers will be used throughout the drawings to refer to the same or like parts.

FIG. 2B illustrates a partial cross-sectioned side view of a circuit breaker neutral connector assembly installed in a pocket of a housing of a circuit breaker in accordance with one or more embodiments.

FIG. 2C illustrates a partial cross-sectioned end view of a circuit breaker neutral connector assembly installed in a pocket of a housing of a circuit breaker in accordance with one or more embodiments.

DESCRIPTION

To assist in making the circuit breaker neutral bar installation process faster, it is desirable to remove the external pigtail and/or the neutral bar screw and replace it with a quick connect feature.

One or more embodiments of the present invention utilize a circuit breaker neutral connector assembly that floats to rapidly make an electrical connection to a panel board neutral bar (sometime referred to as a "neutral rail") in accordance with one or more embodiments. Neutral bar, as used herein, means any elongate structure to which the neutral connector of the circuit breaker is connected to in order to complete an electrical neutral connection to the circuit breaker.

According to one or more embodiments, the neutral bar connection in accordance with one aspect is made by installing the circuit breaker onto the panel board by using a rocking motion, as will be apparent from the following. No special alignment or guidance is required for installation. A bias spring of the circuit breaker neutral connector assembly allows the neutral connector to move (e.g., float) during the installation method. This floating of the neutral connector relative to the housing of the circuit breaker allows for much easier installation and minimizes damage to the neutral connector during installation. In some embodiments, engaging contact (e.g., clamping) of the neutral bar is provided by at least two prongs (e.g., two levers) of the circuit breaker neutral connector assembly. In other embodiments, the bias spring provides a sufficient contact force to extend the neutral connector into engagement with the neutral bar.

Improved connection may be accomplished with the circuit breaker neutral connector assembly mounted to the bottom of the circuit breaker, such as on or near the load side thereof. The circuit breaker neutral connector assembly ensures proper contact force with the neutral bar, proper alignment with the neutral bar, and securely holds the circuit breaker onto the panel board after installation.

These and additional embodiments of the circuit breaker neutral connector assembly, circuit breakers including a circuit breaker neutral connector assembly, and methods of making a neutral connection are provided and described fully with reference to FIGS. 2A-10 herein.

Figure 1A:
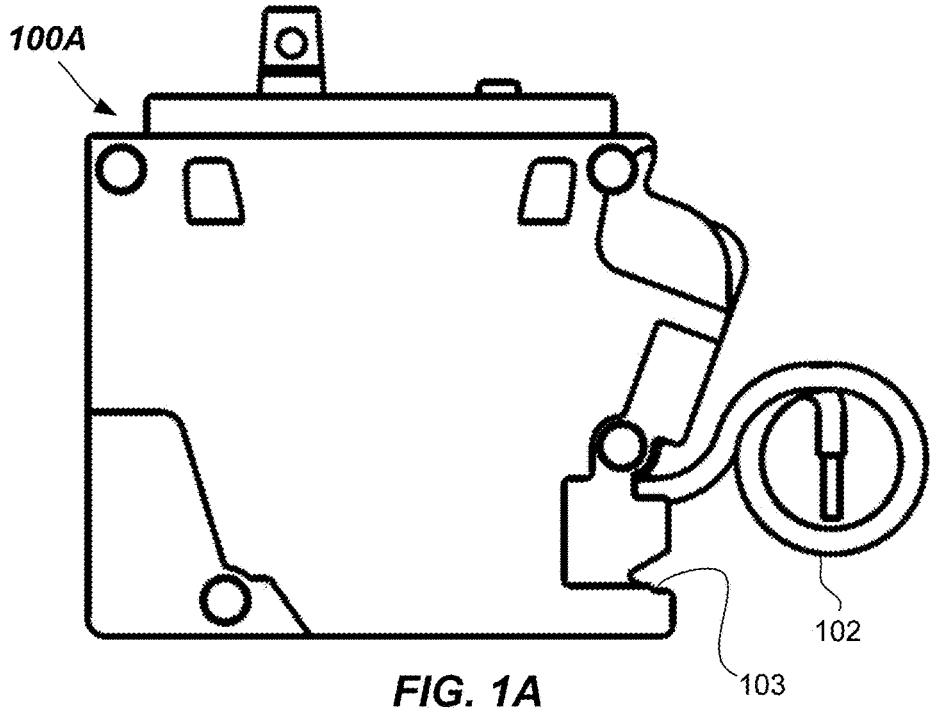
FIGS. 1A and 1B illustrate side views of conventional electronic circuit breakers (e.g., GFCI or CAFCI) with a coiled pigtail (FIG. 1A), and conventional electronic circuit breaker (e.g., GFCI or CAFCI) with C-clip connector (FIG. 1B) adapted to clip onto a neutral bar in accordance with the prior art.
Figure 1B:
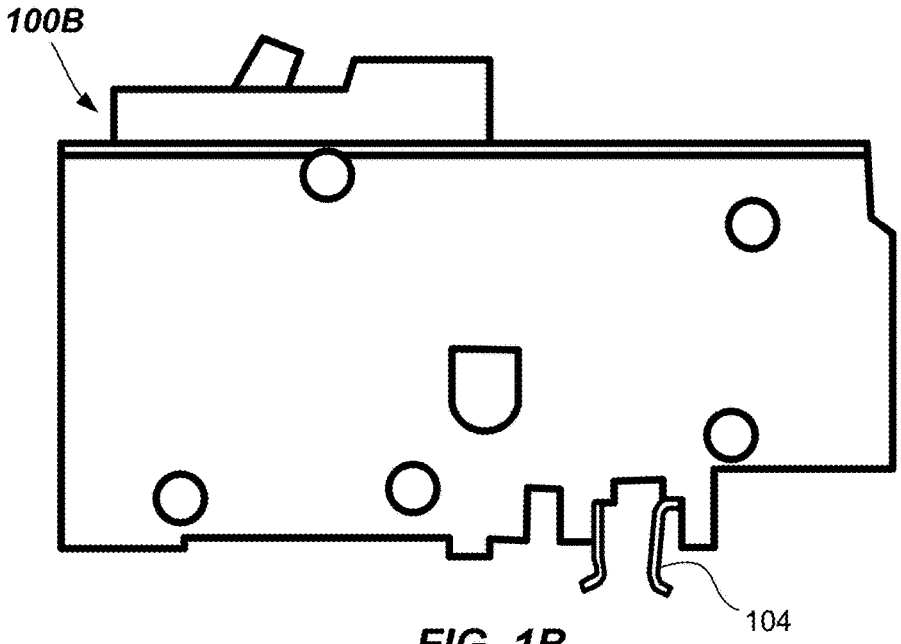
Figure 2A:
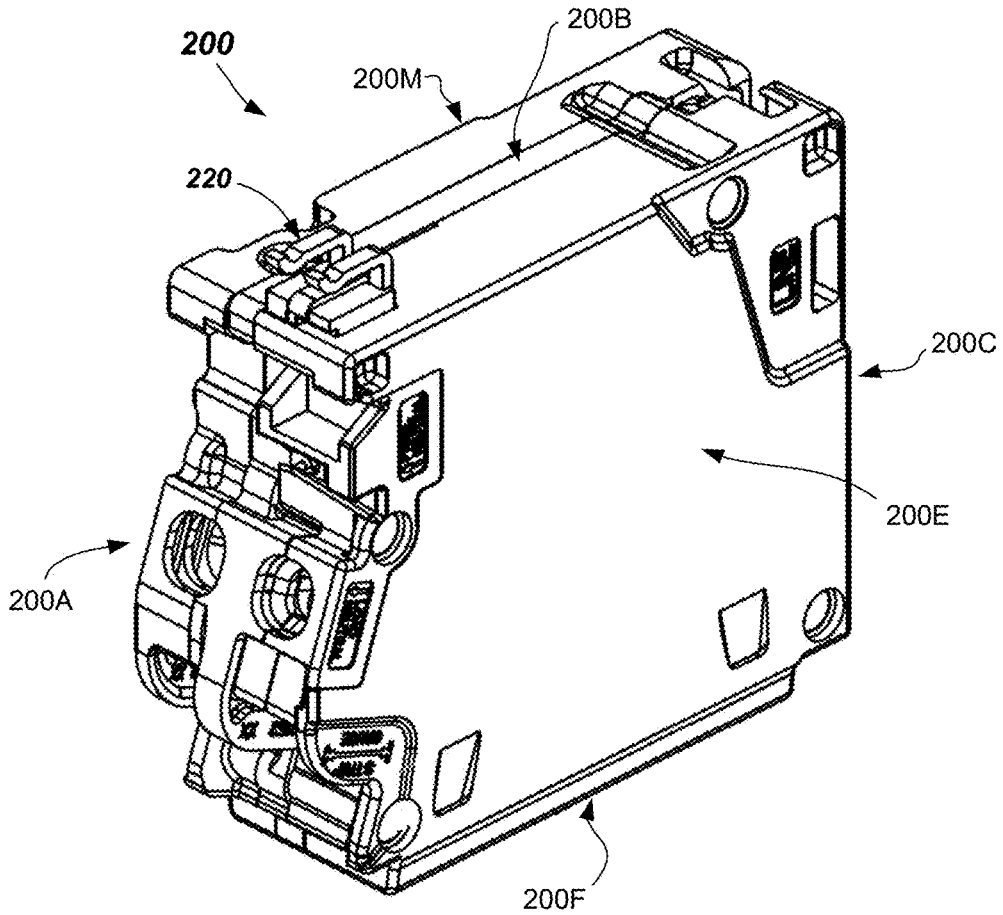
FIG. 2A illustrates an isometric view of a one-pole circuit breaker (e.g., GFCI or CAFCI) including a circuit breaker neutral connector assembly in accordance with one or more embodiments.
Figure 3A:
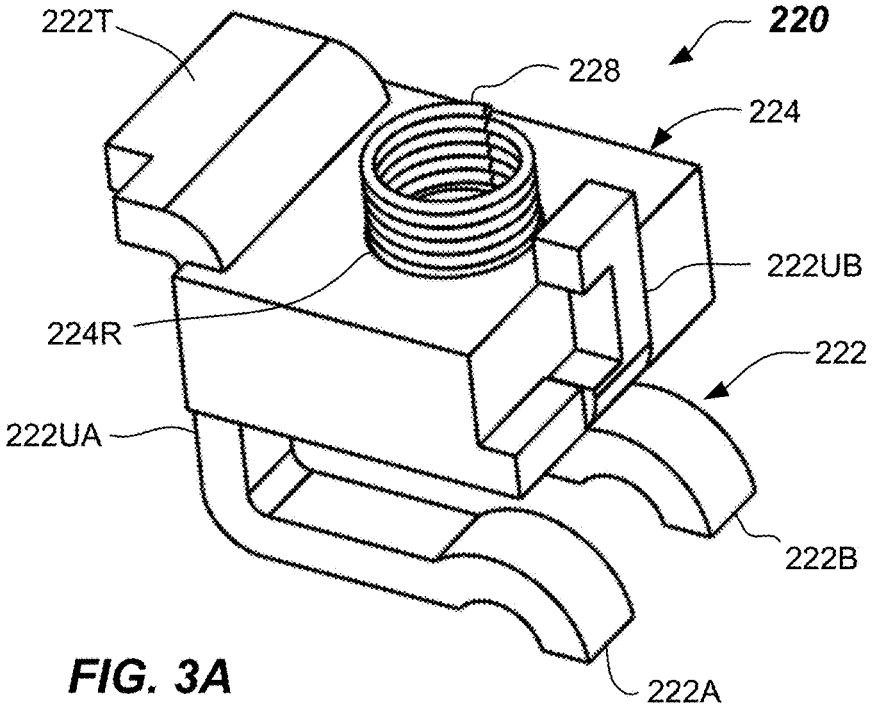
FIGS. 3A and 3B illustrate isometric views of a circuit breaker neutral connector assembly in accordance with one or more embodiments.
Figure 3B:
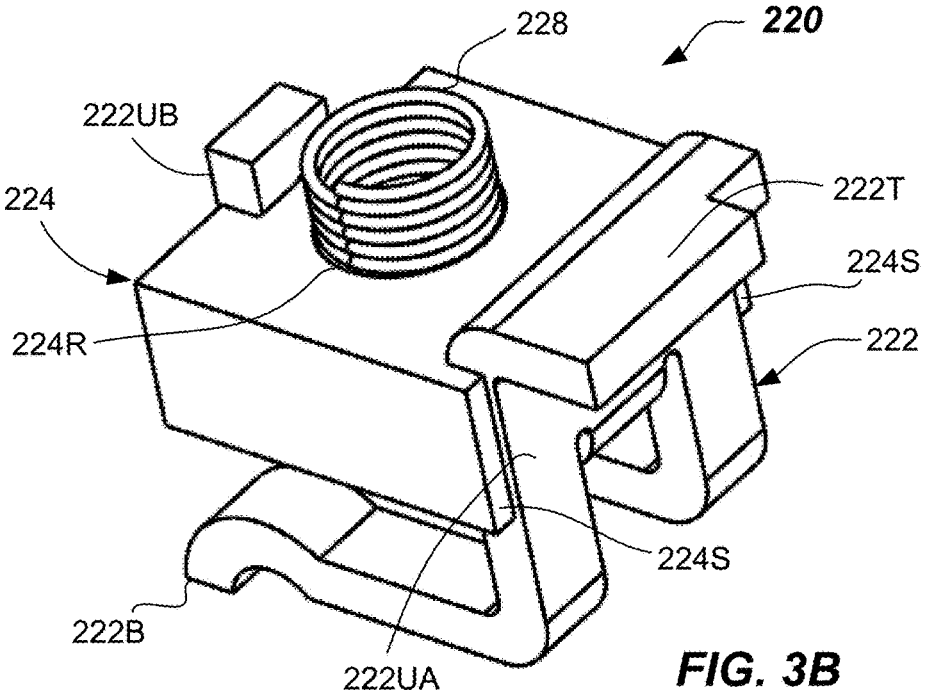
Figure 4A:
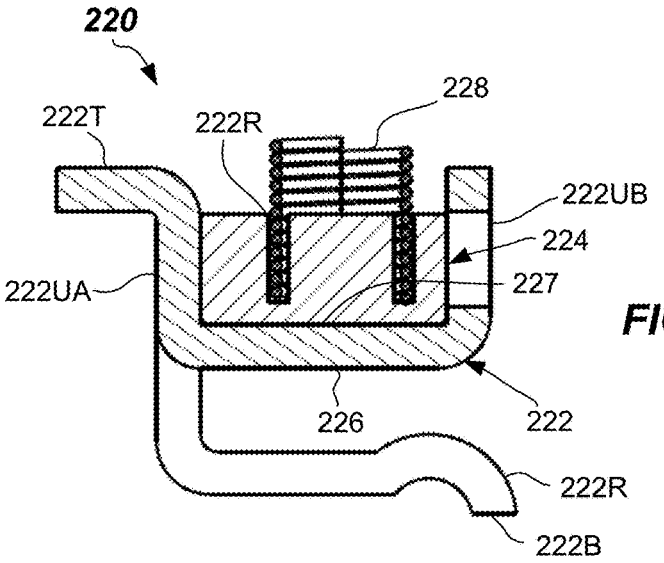
FIGS. 4A through 4C illustrate various side and top plan views of a circuit breaker neutral connector assembly in accordance with one or more embodiments.
Figure 4B:
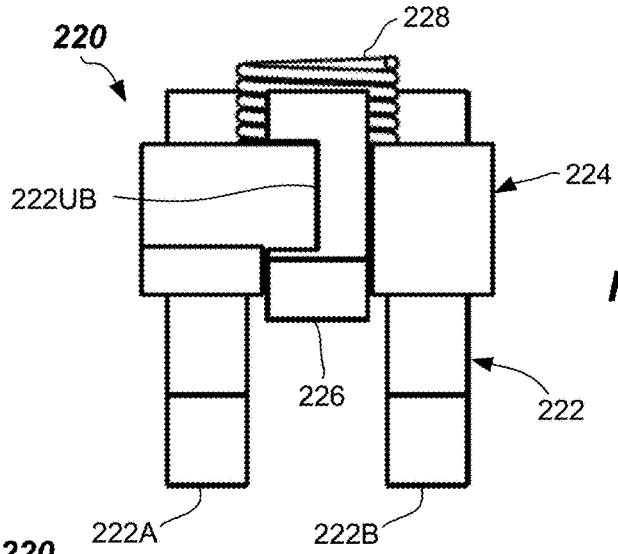
Figure 4C:
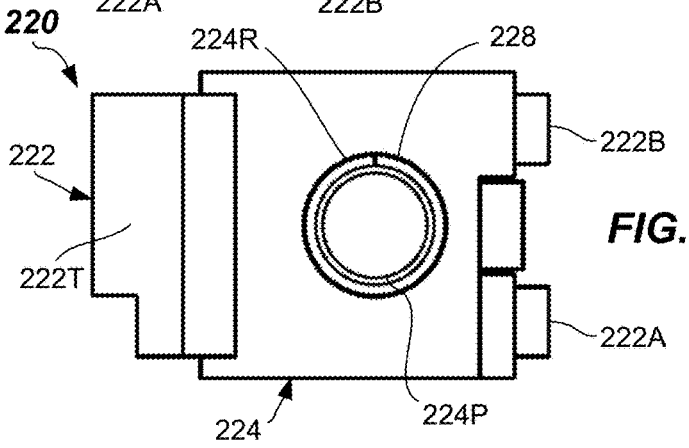

Referring now to FIG. 2A, a circuit breaker 200 including a circuit breaker neutral connector assembly 220 is illustrated. Circuit breaker 200 (shown inverted) includes a front side 200F and a rear side (or bottom) 200B, a load side 200A to which electrical loads (e.g., branch circuits) may be attached, and a line side 200C, which may attach to a line conductor (e.g., a stab on the panel board) via a conventional c-clip line side terminal connector not shown. Such line side terminal connectors are described in U.S. Pat. No. 8,049,126 to Chen, et al., for example. The circuit breaker 200 may include a mechanism pole 200M containing conventional tripping components, such as a cradle, cradle spring, moving contact arm, moving and stationary electrical contacts, armature and a thermal assembly of magnet and bimetal. The circuit breaker 200 may include an electronic pole 200E containing all the conventional electronics and circuit components for sensing and determining an arc fault or ground fault condition. The components of the mechanism pole 200M and the electronic pole 200E, other than the circuit breaker neutral connector assembly 220 and portions of the housing receiving it are conventional and will not be discussed further herein. In the depicted embodiment, the circuit breaker neutral connector assembly 220 is shown located on the bottom 200B and toward the load side 200A of the electronic pole 200E. However, other locations may be used. Further, while a one-pole circuit breaker 200 is shown and described, embodiments of the invention may be adapted for use with two-pole circuit breakers, as well.

Now referring to FIGS. 2B-6E, the circuit breaker neutral connector assembly 220 and components thereof are shown and described. The circuit breaker neutral connector assembly 220 includes a neutral connector 222 including a first side 226 configured to make electrical connection with a neutral bar 225 (shown dotted in FIGS. 2B and 2C) of the panel board (not shown). The neutral connector 222 may have at least one flat surface of the first side 226 that is configured to make electrical contact with a front (top) surface of the neutral bar 225 as shown in FIGS. 2B and 2C. Neutral connector 222 may be a copper alloy material, such as CDA 510 material, for example. Other suitably electrically-conductive materials may be used. Neutral connector 222 may include a large radius (e.g., about 0.06 in (about 1.5 mm)) on the respective end of the first side 226 to help aid in the assembly process with the neutral bar 225 of the panel board.

The neutral connector 222 may further include a first prong 222A and a second prong 222B, each of the first prong 222A and the second prong 222B may be spaced from the first side 226 to form a gap configured to receive the neutral bar 225 therein as shown in FIGS. 2B and 2C. Each of the first prong 222A and the second prong 222B may include a radius 222R at the terminal end to assist in receiving the neutral bar 225. Radius 222R may be between about 0.09 in and about 0.12 in (about 2.3 mm to about 3.0 mm), for example. As the neutral connector 222 is pushed on to the neutral bar 225 of the panel board, the first prong 222A and the second prong 222B deflect like beams and act as a spring to also ensure clamping contact with the neutral bar 225. A neutral conductor wire 229 may be fastened to the neutral connector 222, such as by welding to a tab 222T thereof (FIG. 2B). Neutral conductor wire 229 may also attach to the electronics of the electronic pole 200M as is conventional.

Figure 5A:
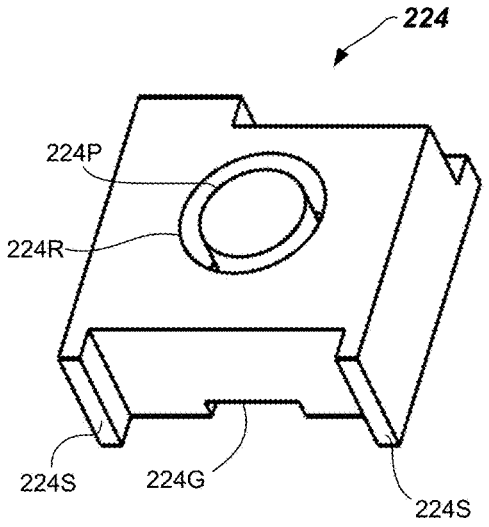
FIGS. 5A and 5B illustrate various isometric views of a shield of a circuit breaker neutral connector assembly in accordance with one or more embodiments.
Figure 5B:
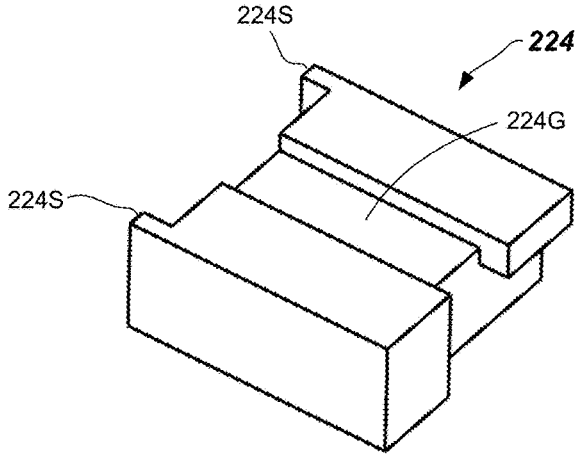
Figure 6A:
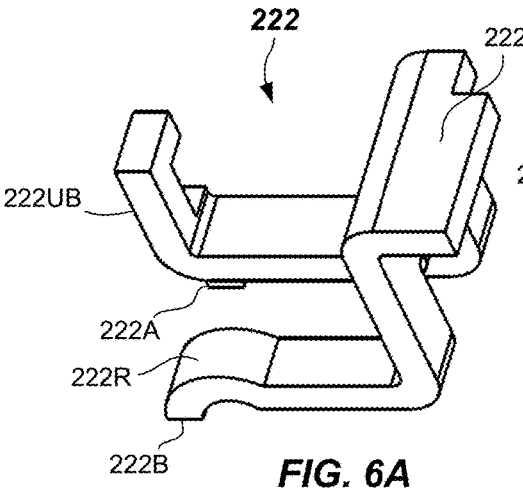
FIGS. 6A through 6E illustrate various views of the neutral connector of a circuit breaker neutral connector assembly in accordance with one or more embodiments.
Figure 6B:
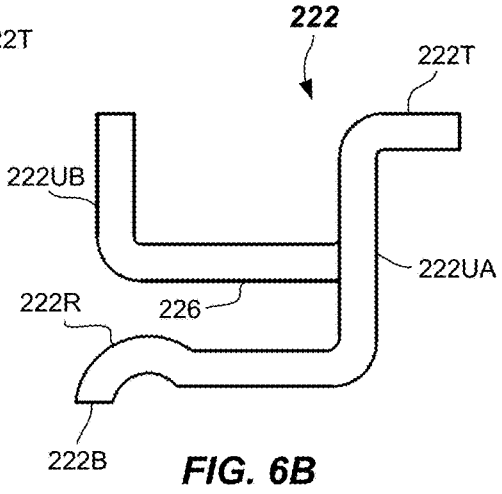
Figure 6C:
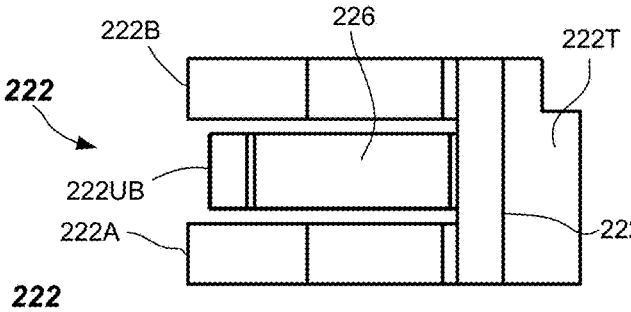
Figure 6D:
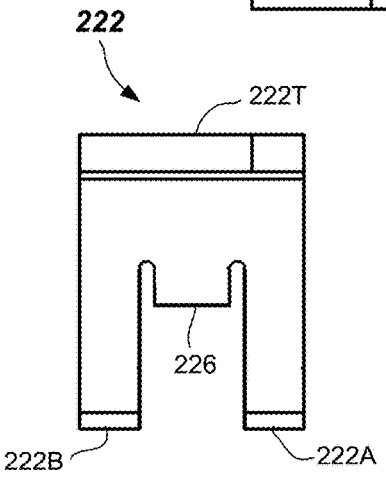
Figure 6E:
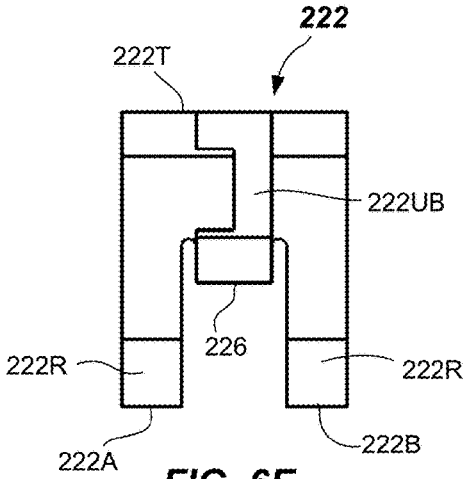

Furthermore, circuit breaker neutral connector assembly 220 includes a shield 224 of an insulating material abutting a second side 227 of the neutral connector 222 opposite the first side 226. Shield 224 may be made of a polymer material, such as a thermoplastic or thermosetting insulating material, for example. Other suitable electrically insulating materials may be used. The neutral connector 222 may be abutted by, and may be partially surrounded by, the shield 224. The shield 224 may include an alignment feature configured to engage and align the neutral connector 222 to the shield 224. For example, the neutral connector 222 may be recessed into a groove 224G formed in the shield 224, as is best shown in FIGS. 5A-5B. The neutral connector 222 may include a first upright 222UA and a second upright 222UB (see FIGS. 3A and 3B), wherein the first and second uprights 222UA, 222UB extend alongside of the shield 224. To further retain the neutral connector 222, the shield 224 may include an alignment feature comprising side walls 224S (FIGS. 3B, 5A, and 5B) on at least one end that straddle and position the respective sides of the neutral connector 222.

Neutral connector assembly 220 may also include a bias spring 228 abutting the shield 224 and configured to spring bias the neutral connector 222 and the shield 224. This biases the floating connector assembly 220 outwardly from the housing 230 and allows the neutral connector 222 to float relative to a housing 230 of the circuit breaker 200. This helps with the alignment of the neutral connector assembly 220 to the neutral bar 225 during assembly thereto. The bias spring 228 may be coil spring (e.g., a metal coil spring) as depicted. Alternatively, other types of metal or even plastic springs may be used, such as a leaf spring, wave spring, Bellville spring, constant force spring, torsion spring, or the like. In this embodiment, the spring rate of the bias spring 228 may be between about 2.0 lb/in and about 4.0 lb/in (about 23 N/cm and about 45 N/cm), and about 2.5 lb/in (about 28 N/cm) in some embodiments. The bias spring 228 may also help to ensure a contact force between the first side 226 of the neutral connector 222 and the neutral bar 225. In some embodiments, one end of the bias spring 228 may be received in a recess 224R, or optionally over a post 224P of the shield 224, or both. The post 224P and/or recess 224R function to capture and help guide the bias spring 228 into position during assembly. The other end of the bias spring 228 may rest against a support surface 231 of the housing 230. The support surface 231 may be formed in a recess that aids in positioning the bias spring 228.

The housing 230, as best shown in FIGS. 2B and 2C, may include a first support wall 232 on a first lateral side of the shield 224, and a second support wall 234 on a second lateral side of the shield 224, wherein the first lateral side is opposite the second lateral side. The first support wall 232 may be part of the housing 230 of the mechanism pole 200M and may provide lateral support for the circuit breaker neutral connector assembly 220 to float within the housing 230. The second support wall 234 may be part of the housing 230 of the electronic pole 200E, and may provide another lateral supporting surface for the shield 224. Both the first support wall 232 and the second support wall 234 provide a surface for the lateral sides 224A, 224B of the shield 224 to slide against so that the shield 224 and the neutral connector 222 stay in position laterally and also not rotate (FIG. 2C). First support wall 232 of mechanical pole hosing 230M and second support wall 234 of electronic pole housing 230E may be appropriately sized to allow a sliding fit against the side walls 224A, 224B of the shield 224 with little resistance. In addition, a load side facing wall 236 and a line side facing wall 238 may be provided in the electronic pole housing 230E to act as a lateral guide for the vertical walls 222UA, 222UB of the neutral connector 222 so that the neutral connector 222 can float relative to the housing 230.

In order to limit the amount of float of the neutral connector 222, one or more sides of the housing 230 of the electronic pole 200E may include one or more stops. The one or more stops act as a limit stop for the neutral connector assembly 220 when the circuit breaker 200 is not installed onto the panel board. For example, in the depicted embodiment, a first extension stop 241 of the neutral connector 222 is configured to engage with a first limit stop 242 formed or included on the housing 230. In one or more embodiments, a second extension stop 243 of the neutral connector 222 is configured to engage with a second limit stop 244. The neutral connector 222 may comprise the first extension stop 241 coupled to a first side and the second extension stop 243 coupled to a second side.

Figure 7A:
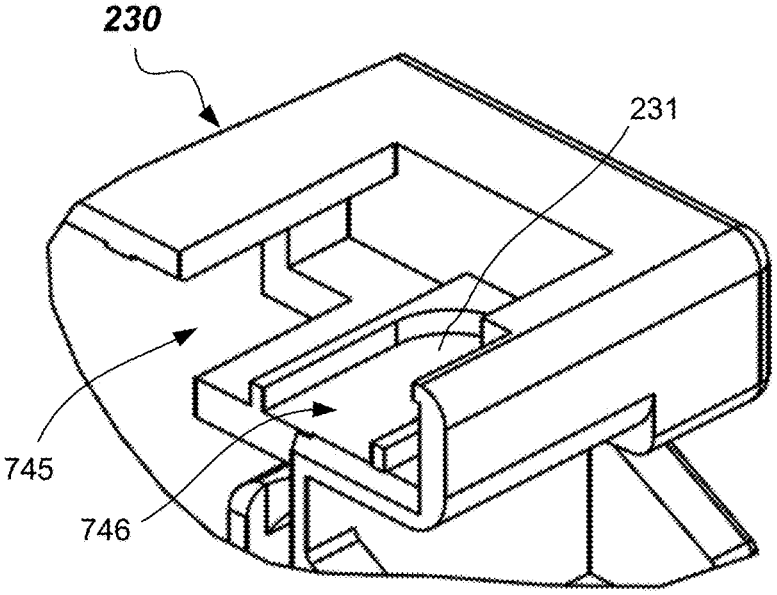
FIGS. 7A and 7B illustrate partial isometric and plan views, respectively, of a housing showing various views of a pocket adapted to receive at least a portion of a circuit breaker neutral connector assembly in accordance with one or more embodiments.
Figure 7B:
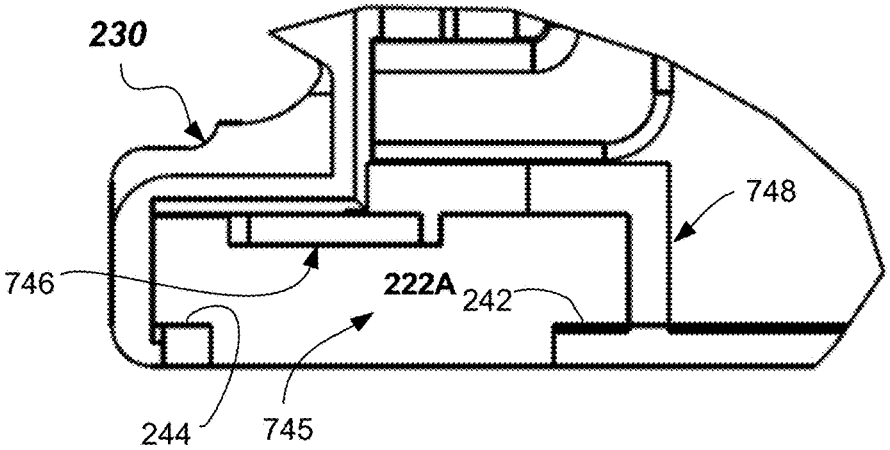

FIGS. 7A and 7B illustrate detailed partial views showing a pocket 745 the housing 230 where the neutral connector assembly 220 is located within the electronic pole 200E. The pocket 745 receives at least a portion of the neutral connector assembly 220, and it is received in a compressed condition (bias spring 228 compressed). The bias spring 228 may be slid into the slide channel 746 including the support surface 231 and be expanded to rest against the support surface 231. An opening 748 may be provided in the housing 230 to provide clearance for the neutral conductor wire 229 to floating connector weld joint. This opening 748 allows the neutral conductor wire 229 to move as the neutral connector 222 is moving or floating within its boundaries (limits).

Figure 8A:
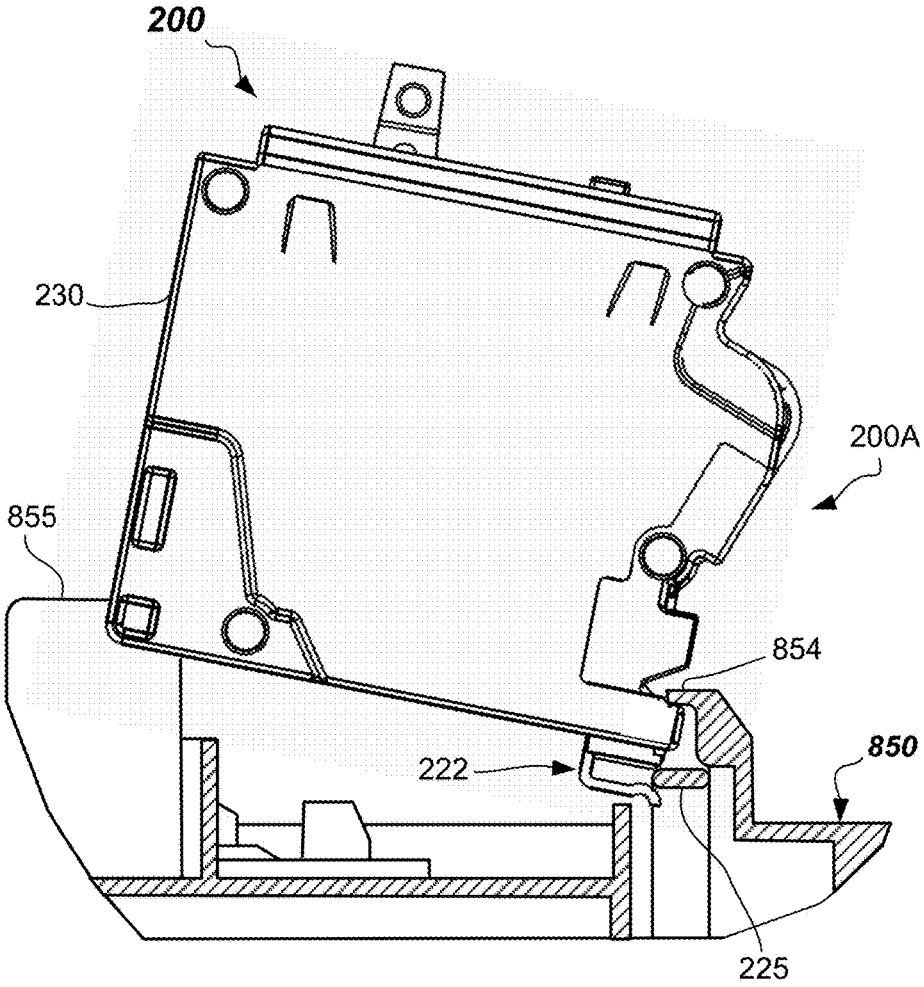
FIG. 8A is an example of the initial position of a method of installing a circuit breaker with a circuit breaker neutral connector assembly to a panel board and neutral bar in accordance with one or more embodiments.
Figure 8B:
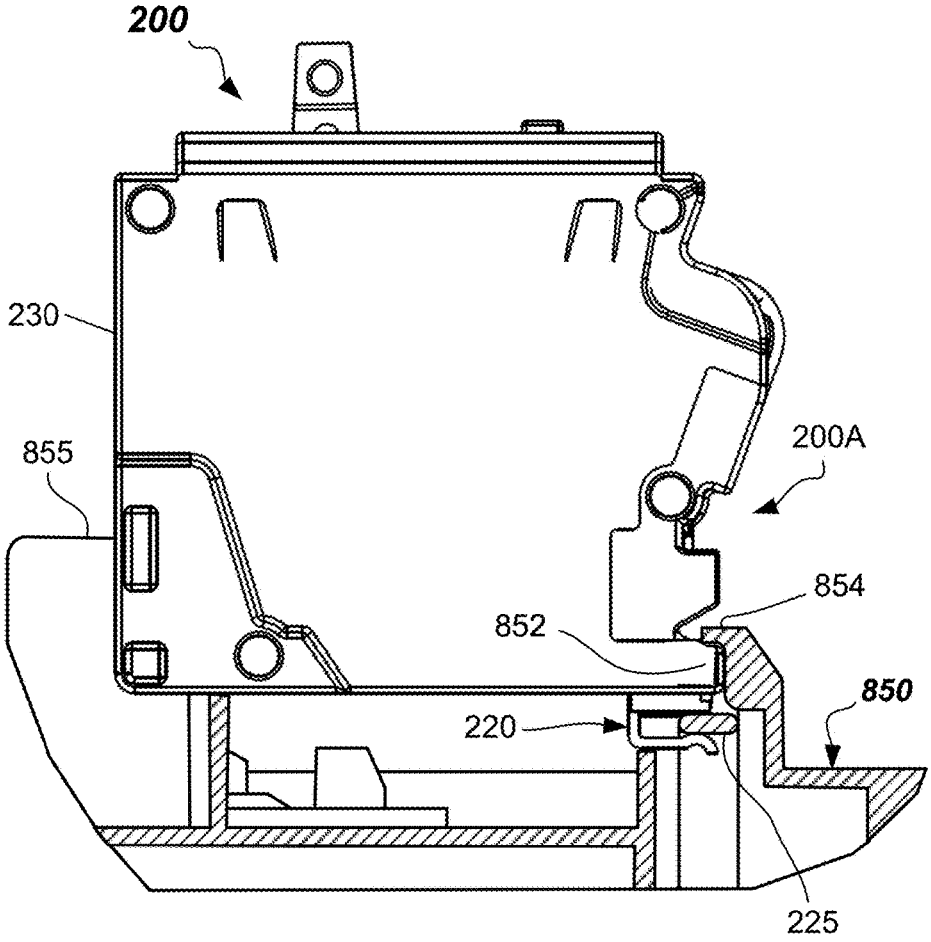
FIG. 8B is an example of a circuit breaker with a circuit breaker neutral connector assembly fully installed to electrically connect to a neutral bar of the panel board in accordance with one or more embodiments.

As shown in FIGS. 8A and 8B, during installation, the load side 200A of the circuit breaker 200 is rotated (e.g., rocked) into position on the panel board 850 and stab 855. The securing protrusion 852 on the housing 230 is received under the panel board hook 854 which may be molded on the panel board 850, and the neutral connector 222 is started onto the neutral bar 225. As the circuit breaker 200 is further rotated so that the line side 200C of the circuit breaker 200 is pressed onto the stab 855, the neutral connector 222 (FIG. 2B, 2C) may be compressed and properly aligned with the neutral bar 225. This ability to align with the neutral bar 225 during installation minimizes deflection of the first and second prongs 222A, 222B, and promotes a constant contact force between neutral connector 222 and neutral bar 225. FIG. 8B illustrates the circuit breaker 200 fully installed to the panel board 850 and with the neutral connector assembly 220 secured and electrically connected to the neutral bar 225. As can be seen, the entire load side is captured underneath the panel board hook 854 and the neutral connector 222 is received laterally over the neutral bar 225

Figure 9A:
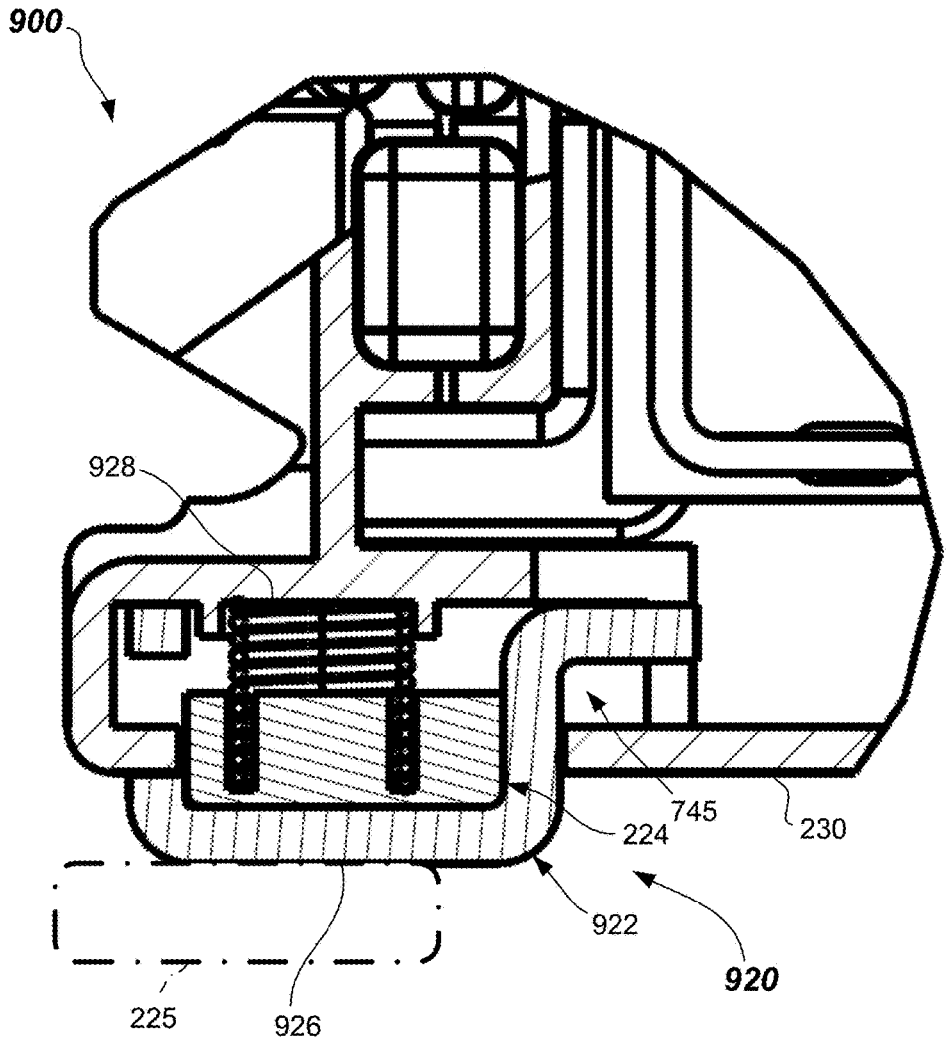
FIG. 9A illustrates a partial side view of an alternate circuit breaker neutral connector assembly installed in a circuit breaker in accordance with one or more embodiments.
Figure 9B:
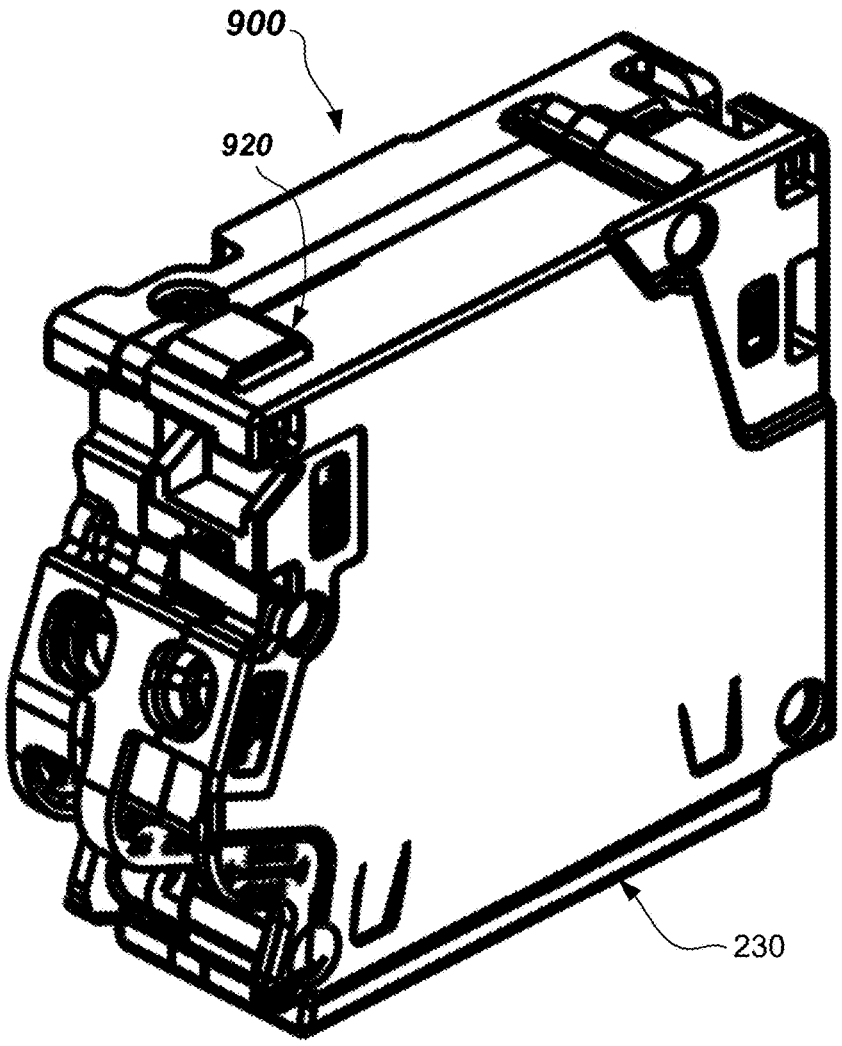
FIG. 9B illustrates an isometric view of a circuit breaker including an alternate circuit breaker neutral connector assembly in accordance with one or more embodiments.

An alternate embodiment of the neutral connector assembly 920 is shown in FIG. 9. In this embodiment, the connection between the neutral connector 922 and the neutral bar 225 is accomplished by using only the spring force of the bias spring 928, as the neutral connector 922 is devoid of the first and second prongs 222A, 222B of the FIG. 2B-2C embodiment. Neutral connector 922 is designed to float within the pocket 745 of the housing 230, as previously discussed. As shown, the circuit breaker 900

(only a portion shown) is installed and the neutral connector 922 is in electrical engagement with the neutral bar 225 with the bias spring 928 shown compressed. In this embodiment, a contact force of about 7 lb (about 31 N) may be provided against the neutral bar 225 to ensure a secure electrical neutral connection with the neutral bar 225. The bias spring 928 in this embodiment may have a spring rate of between about 20 lb/in and about 40 lb/in (between about 226 N/cm to about 452 N/cm), for example. Other spring rates may be used. The contact surface area of the neutral connector 922 with the neutral bar 225 may be greater that about 0.08 $in^2$ (greater that about 0.52 $cm^2$), for example.

Figure 10:
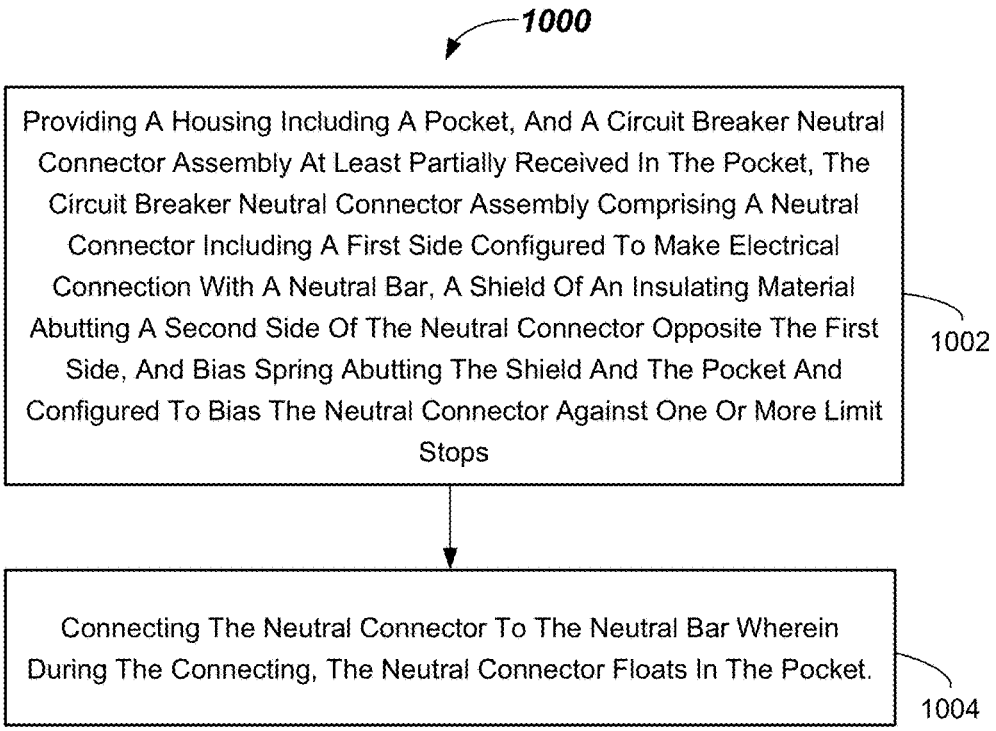
FIG. 10 illustrates a flowchart of a method of making a neutral connection with a neutral connector assembly in accordance with one or more embodiments.

In another aspect, a method of making a neutral connection is described with reference to FIG. 10. In 1002, the method 1000 includes providing a housing (e.g., housing 230) including a pocket (e.g., pocket 745), and a circuit breaker neutral connector assembly (e.g., circuit breaker neutral connector assembly 220, 920) at least partially received in the pocket, the circuit breaker neutral connector assembly comprising a neutral connector (e.g., neutral connector 222, 922) including a first side (e.g., first side 226, 926) configured to make electrical connection with a neutral bar (e.g., neutral bar 225), a shield (e.g., shield 224) of an insulating material abutting a second side (e.g., second side 227) of the neutral connector opposite the first side, and bias spring (e.g., bias spring 228, 928) abutting the shield and the pocket and configured to bias the neutral connector against one or more limit stops.

The method 1000 includes, in 1004, connecting the neutral connector (e.g., neutral connector 222, 922) to the neutral bar (e.g., neutral bar 225) wherein during the connecting, the neutral connector floats in the pocket. Once installed, the bias spring (e.g., 228, 928) biases the neutral connector (e.g., 222, 922) to provide a contact force against the neutral bar (e.g., neutral bar 225).

While the invention is susceptible to various modifications and alternative forms, specific embodiments and methods thereof have been shown by way of example in the drawings and are described in detail herein. It should be understood, however, that it is not intended to limit the invention to the particular apparatus, systems or methods disclosed, but, to the contrary, the intention is to cover all modifications, equivalents and alternatives falling within the scope of the invention.

What is claimed is:

1. Circuit breaker neutral connector assembly, comprising:

a neutral connector including a first side configured to make an electrical connection with a neutral bar on a top of the neutral bar;

a shield of an insulating material having a connector side abutting a second side of the neutral connector opposite the first side; and a bias spring abutting a spring side of the shield opposite the connector side and configured to bias the neutral connector.

2. The circuit breaker neutral connector assembly of claim 1, wherein the neutral connector comprises a first prong and a second prong, each of the first prong and the second prong being spaced from the first side to form a gap configured to receive the neutral bar therein.

3. The circuit breaker neutral connector assembly of claim 1, comprising a neutral conductor wire fastened to the neutral connector.

4. The circuit breaker neutral connector assembly of claim 1, wherein the neutral connector comprises a first upright and a second upright, wherein the first upright and the second upright extend alongside of the shield.

5. The circuit breaker neutral connector assembly of claim 1, wherein the bias spring is received in a recess or on a post of the shield.

6. The circuit breaker neutral connector assembly of claim 1, wherein the neutral connector comprises a first extension stop coupled to a first end and a second extension stop coupled to a second end.

7. The circuit breaker neutral connector assembly of claim 1, wherein the shield comprises an alignment feature configured to engage and align the neutral connector to the shield.

8. The circuit breaker neutral connector assembly of claim 1, wherein the shield includes a groove that receives the neutral connector therein.

9. The circuit breaker neutral connector assembly of claim 1, comprising a first extension stop of the neutral connector configured to engage with a first limit stop.

10. The circuit breaker neutral connector assembly of claim 9, wherein the first limit stop is included in a housing of a circuit breaker.

11. The circuit breaker neutral connector assembly of claim 9, comprising a second extension stop of the neutral connector configured to engage with a second limit stop.

12. A circuit breaker, comprising:

a housing including a pocket; and a neutral connector assembly at least partially received in the pocket, the neutral connector assembly comprising:

a neutral connector including a first side configured to make an electrical connection with a neutral bar on a top of the neutral bar, a shield of an insulating material having a connector side abutting a second side of the neutral connector opposite the first side, and a bias spring abutting a spring side of the shield opposite the connector side and abutting the pocket and configured to bias the neutral connector against limit stops.

13. The circuit breaker of claim 12, wherein the neutral connector comprises a first prong and a second prong, wherein each of the first prong and the second prong are spaced from the first side to form a gap configured to receive the neutral bar therein.

14. The circuit breaker of claim 12, comprising a neutral conductor wire fastened to the neutral connector.

15. The circuit breaker of claim 12, wherein the bias spring is received in a recess or on a post of the shield.

16. The circuit breaker of claim 12, wherein the neutral connector comprises a first extension stop coupled to a first end, and a second extension stop coupled to a second end.

17. The circuit breaker of claim 12, comprising a first extension stop of the neutral connector configured to engage with a first limit stop.

18. The circuit breaker of claim 17, wherein the first limit stop is included in the housing.

19. The circuit breaker of claim 17, comprising a second extension stop of the neutral connector is configured to engage with a second limit stop.

20. A method of making a neutral connection, comprising:

providing a housing including a pocket, and a circuit breaker neutral connector assembly at least partially received in the pocket, the circuit breaker neutral connector assembly comprising a neutral connector including a first side configured to make an electrical connection with a neutral bar on a top of the neutral bar, a shield of an insulating material having a connector side abutting a second side of the neutral connector opposite the first side, and a bias spring abutting a spring side of the shield opposite the connector side and abutting the pocket and configured to bias the neutral connector against one or more limit stops; and connecting the neutral connector to the top of the neutral bar wherein during the connecting, the neutral connector floats in the pocket.

* * * * *